US007336268B1

(12) United States Patent
Camp et al.

(10) Patent No.: US 7,336,268 B1
(45) Date of Patent: Feb. 26, 2008

(54) POINT-TO-POINT DISPLAY SYSTEM HAVING CONFIGURABLE CONNECTIONS

(75) Inventors: Donald E. Camp, Peoria, AZ (US); Mark D. Kuhns, Peoria, AZ (US); Randy J. Dahl, Glendale, AZ (US); Osama F. Alborno, Chandler, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 381 days.

(21) Appl. No.: 10/285,243

(22) Filed: Oct. 30, 2002

(51) Int. Cl.
*G09G 5/00* (2006.01)

(52) U.S. Cl. ..... 345/204; 345/205; 345/206; 345/210; 345/211

(58) Field of Classification Search ..... 345/204–211, 345/582, 589, 532, 581, 501–505, 541–545, 345/100, 30, 563, 644, 87; 365/200; 370/486; 382/232, 432; 348/61; 250/208.1; 369/59.2; 358/488; 709/228; 716/4
See application file for complete search history.

(56) References Cited

U.S. PATENT DOCUMENTS 4,558,315 A * 12/1985 Weiss et al. ..... 345/55
4,730,212 A * 3/1988 Wojcik et al. ..... 348/61
4,837,845 A * 6/1989 Pruett et al. ..... 382/297
4,847,829 A * 7/1989 Tompkins et al. ..... 370/260
5,008,868 A * 4/1991 Ikegami ..... 368/88
5,146,592 A * 9/1992 Pfeiffer et al. ..... 715/807
5,165,089 A * 11/1992 Jaquette et al. ..... 369/59.2
5,307,056 A * 4/1994 Urbanus ..... 345/543
5,381,163 A * 1/1995 Yokoyama ..... 345/658
5,384,912 A * 1/1995 Ogrinc et al. ..... 345/501
5,438,663 A * 8/1995 Matsumoto et al. ..... 345/520
5,564,117 A * 10/1996 Lentz et al. ..... 345/502
5,640,545 A * 6/1997 Baden et al. ..... 345/545
5,754,156 A * 5/1998 Erhart et al. ..... 345/98
5,835,792 A * 11/1998 Wise et al. ..... 710/68
5,945,997 A * 8/1999 Zhao et al. ..... 345/581
5,949,421 A * 9/1999 Ogletree et al. ..... 345/419
5,999,189 A * 12/1999 Kajiya et al. ..... 382/232
6,040,815 A * 3/2000 Erhart et al. ..... 345/98
6,064,404 A * 5/2000 Aras et al. ..... 345/530
6,191,405 B1 * 2/2001 Mishima et al. ..... 250/208.1
6,272,150 B1 * 8/2001 Hrastar et al. ..... 370/486
6,288,723 B1 * 9/2001 Huff et al. ..... 345/644
6,292,194 B1 * 9/2001 Powell, III ..... 345/582
6,433,896 B1 * 8/2002 Ueda et al. ..... 358/488
6,574,778 B2 * 6/2003 Chang et al. ..... 716/1
6,677,952 B1 * 1/2004 Baldwin ..... 345/505
6,698,002 B2 * 2/2004 Chang et al. ..... 716/4
6,833,832 B2 * 12/2004 Wolverton ..... 345/532
6,970,152 B1 * 11/2005 Bell et al. ..... 345/100
2002/0099980 A1 * 7/2002 Olarig ..... 714/43
2002/0184373 A1 * 12/2002 Maes ..... 709/228
2003/0227465 A1 * 12/2003 Morgan et al. ..... 345/589

FOREIGN PATENT DOCUMENTS

WO WO 98/28731 * 7/1998 ..... 345/100

* cited by examiner

*Primary Examiner*—Prabodh Dharia
(74) *Attorney, Agent, or Firm*—Merchant & Gould PC

(57) ABSTRACT

An exemplary point-to-point display system comprises a host system, a timing controller, and a display. The host system is configured to provide data for display. The timing controller is configurable to provide data swapping, bus swapping, bit swapping, and combinations thereof to provide arranged data in response to the provided data. The display is configured to display the arranged data.

21 Claims, 11 Drawing Sheets

POINT-TO-POINT DISPLAY SYSTEM HAVING CONFIGURABLE CONNECTIONS

FIELD OF THE INVENTION

The present invention relates generally to computer systems, and more particularly to arranging and displaying data on computer systems.

BACKGROUND OF THE INVENTION

Integrated circuit technology is used to implement various display architectures within computer systems. The integrated circuits can be mounted in a variety of ways in a display system.

SUMMARY OF THE INVENTION

The present invention is directed towards a point-to-point display system having configurable connections. According to one aspect of the invention, a display system comprises a host system, a timing controller, and a display. The host system is configured to provide data for display. The timing controller is configurable to provide data swapping, bus swapping, bit swapping, and combinations thereof to provide arranged data in response to the provided data. The display is configured to display the arranged data.

According to another aspect of the invention, a method for arranging data for display comprises receiving data from a host system for display. Data swapping, bus swapping, bit swapping, and combinations thereof are performed on the data to provide arranged data. The arranged data is displayed.

A more complete appreciation of the present invention and its improvements can be obtained by reference to the accompanying drawings, which are briefly summarized below, to the following detailed description of illustrated embodiments of the invention, and to the appended claims.

DETAILED DESCRIPTION OF THE PREFERRED EMBODIMENT

Figure 1:
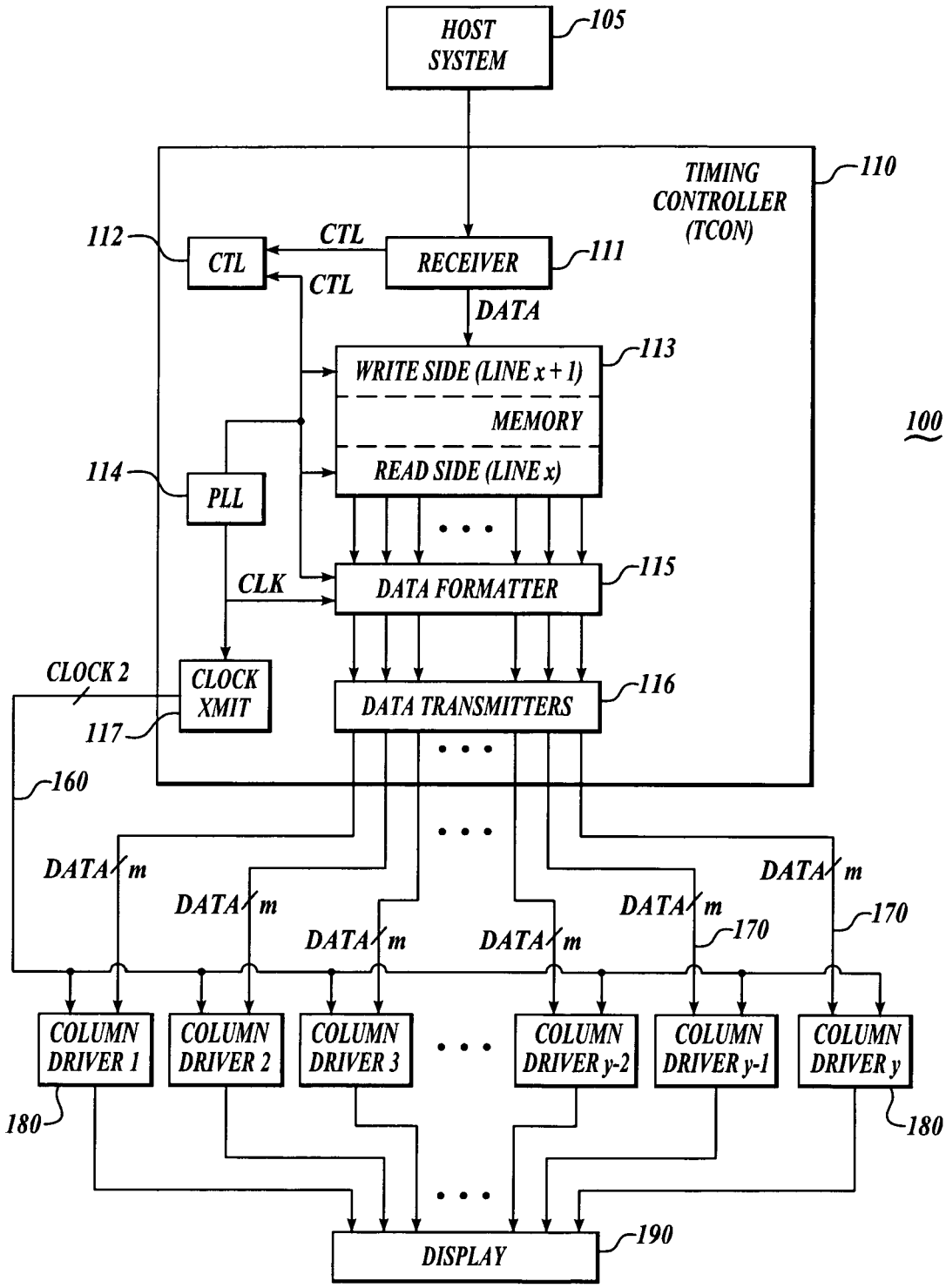
FIG. 1 is a schematic of an example point-to-point display system in accordance with the present invention.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

FIG. 1 is a schematic of an example point-to-point display system in accordance with the present invention. System 100 includes Host System 105, display device timing controller (TCON) 110, drivers 180, and Display 190. Host System 105 may be any system (a computer, for example) that is suitable for generating data for display. Host System 105 typically comprises a CPU, RAM, ROM, a mass memory storage device (and/or network interface for accessing data stores), a power supply, a chassis, and the like. TCON 110 typically comprises Receiver 111, Control Block 112, Line Memory 113, PLL 114, Data Formatter 115, Data Transmitter 116, and Clock Transmitter 117. TCON 110 formats data for display on Display 190 in response to pixel data and control signals received from Host System 105. Display 190 is typically a display panel and may be any display that use column or row drivers.

Receiver 111 provides control signals to Control Bock 112 and data to Line Memory 113 in response to the pixel data and control signals (including a clock signal) received from Host System 105. Control Block 112 provides control signals to Line Memory 113, PLL 114, and Data Formatter 115 in response to the control signals provided by Receiver 111. Line Memory 113 is a line memory buffer that stores data received from Receiver 111 and outputs stored data to Data Formatter 115 in response to control signals provided by Control Block 112.

Data Transmitters 116 transmit the formatted data to Drivers 180 using separate point-to-point data busses 170 to transmit data to each Driver 180. Each data bus 170 can be 2, 3, or 4 data lines wide, although are other widths are possible. PLL 114 is optional and may be used to provide a transmitter clock that is different from the clock provided by Host System 105. TCON 110 may use the Host System Clock 105 when a PLL 114 is not provided. Clock transmitter 117 transmits a clock signal to each Driver 180 using multi-drop clock bus 160. Clock bus 160 is typically a differential clock, although other clocking schemes (such as a single ended clock) can be used.

TCON 110 is configured to be mounted on either the front or back side of a printed circuit board (PCB). The PCB can be mounted to Display 190 at either the left or right (or top or bottom, for example) of an attachment point (e.g., a panel) of Display 190. Drivers 180 can be mounted to the front or back side of a tape carrier package (TCP). The TCP can be mounted, for example, at either the top or bottom of the attachment point of Display 190. Thus, at least eight basic variations are possible for mounting TCON 110 with respect to Display 190. The eight basic variations are shown below with respect to FIGS. 4-11.

Figure 2:
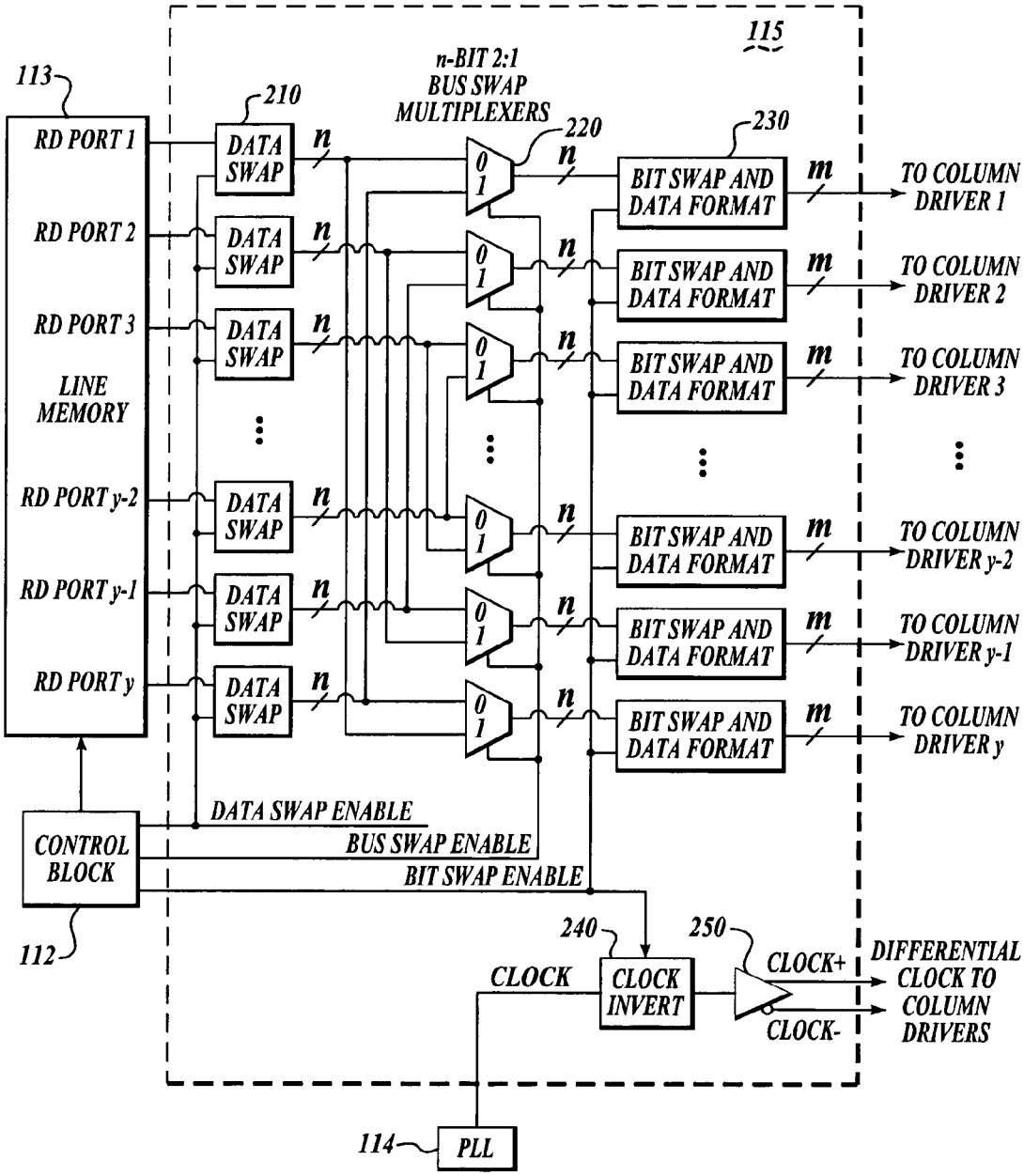
FIG. 2 is a schematic of an example data formatter in accordance with the present invention.

FIG. 2 is a schematic of an example data formatter in accordance with the present invention. Data Formatter 115 is configured to provide at least three independent formatting functions that simplify the routing of signal lines on a PCB: data swapping, bus swapping, and bit swapping. Data Formatter 115 may be further configured to change the width of each word of provided display data.

As shown in the figure, Data Formatter 115 comprises Data Swap Buffers 210, Bus Swap Multiplexers 220, and Bit Swap Multiplexers 230. Control signals for configuring these functional units may be provided, for example, by input function pins or by programming an internal function register.

Each read port in Line Memory 113 provides data for each point-to-point output data bus in Data Formatter 115. Each Data Swap Buffer 210 receives serial data from a read port in Line Memory 113. Data Swap Buffers 210 can transmit the received data in the same order as the sequence in which the data was received or can transmit received data in the opposite order of the sequence in which the data was received. Data Swap Buffers 210 transmit the received data in the same order as the sequence in which the data was received in response to the Data Swap Enable signal being negated. Data Swap Buffer 210 transmits the received data in the opposite order as the sequence in which the data was received in response to the Data Swap Enable signal being asserted.

In an example system having Drivers 118 where each driver has 384 outputs, provided pixel data for display is read from a read port on the line memory in a forward order (R1, G2, B3, R4, . . . R382, G383, B384, where R, G, and B are display colors in an additive color system). When the Data Swap Enable signal is negated (i.e., not enabled), Data Swap Buffer 210 transmits the received data in the same order in which the data was received (i.e., in a forward order). When the Data Swap Enable signal is enabled, Data Swap Buffer 210 transmits the received data in a reverse order from which the data was received (e.g., B384, G383, R382, . . . R4, B3, G2, R1).

Bus Swap Multiplexers 220 can be used to swap data between opposing (or, higher order and lower order) point-to-point output data busses. In an example system having y Drivers 210, the example system will have y point-to-point output data busses. Bus Swap Multiplexers 220 are configured to swap data between bus 1 and bus y, between bus 2 and bus y-1, between bus 3 and bus y-2, et cetera, in response to the Bus Swap Enable signal being asserted. Bus Swap Multiplexers are configured to transmit received data without swapping in response to the Bus Swap Enable signal being negated.

Bit Swap Multiplexers 230 can format the size of pixel data and reverse the order of the bits of pixel data on each point-to-point output data bus. For example in a System 100 having pixel data words having n bits, Bit Swap Multiplexers 230 can be configured to provide pixel data words having m bits. Where n is larger than m, Bit Swap Multiplexers 230 may truncate the lower order bits of the pixel data.

The output bit swap function also affects the differential output clock that is driven by Clock Driver 250. Clock Inverter 240 is configured to provide a noninverted clock signal in response to the Bit Swap Enable signal being negated. Clock Inverter 240 is configured to provide an inverted clock signal in response to the Bit Swap Enable signal being asserted. This has the effect of swapping the Clock+ and Clock-signals provided by Clock Driver 250. (In an alternate example, the positive and negative clocks can be swapped using a multiplexer.)

Figure 3A:
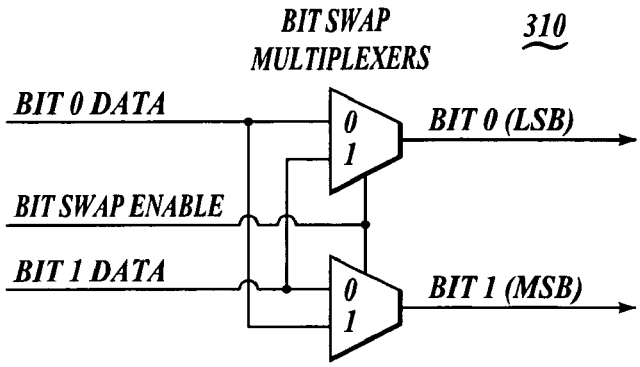
FIG. 3*a* is a schematic of an example 2-bit multiplexer for bit swapping in accordance with the present invention.

FIG. 3*a* is a schematic of an example 2-bit multiplexer for bit swapping in accordance with the present invention. Multiplexer 310 is configured to pass pixel data unchanged in response to the Bit Swap Enable signal being negated. Multiplexer 310 is configured to exchange the lower order bit with the higher order bit of the pixel data in response to the Bit Swap Enable signal being asserted.

Figure 3B:
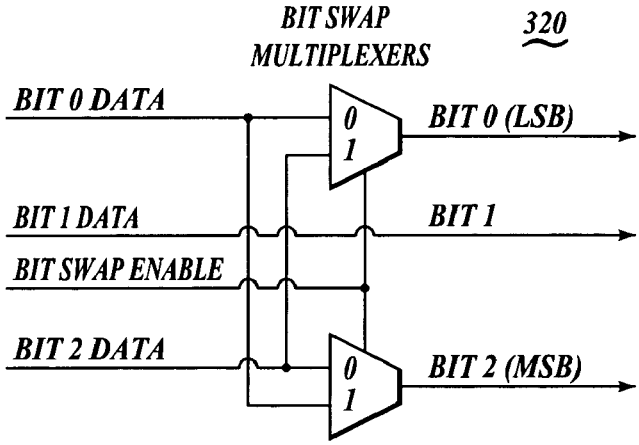
FIG. 3*b* is a schematic of an example 3-bit multiplexer for bit swapping in accordance with the present invention.

FIG. 3*b* is a schematic of an example 3-bit multiplexer for bit swapping in accordance with the present invention. Multiplexer 320 is configured to pass pixel data unchanged in response to the Bit Swap Enable signal being negated. Multiplexer 320 is configured to exchange the lower order bit with the higher order bit of the pixel data in response to the Bit Swap Enable signal being asserted. Bit 1 (the "middle" bit) is the same regardless of the status of the Bit Swap Enable signal.

Figure 3C:
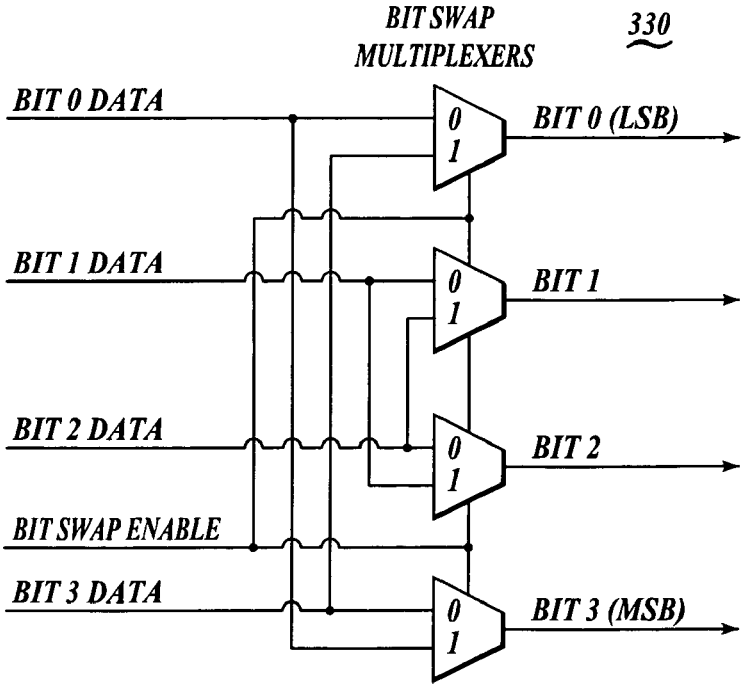
FIG. 3*c* is a schematic of an example 4-bit multiplexer for bit swapping in accordance with the present invention.

FIG. 3*c* is a schematic of an example 4-bit multiplexer for bit swapping in accordance with the present invention. Multiplexer 330 is configured to pass pixel data unchanged in response to the Bit Swap Enable signal being negated. Multiplexer 330 is configured to exchange the lower order bits with the higher order bits of the pixel data in response to the Bit Swap Enable signal being asserted. For example, bit 0 is exchanged with bit 3 and bit 1 is exchanged with bit 2 of a pixel data word. Pixel data words of larger widths can be implemented in similar fashion to the multiplexers shown above.

Figure 4:
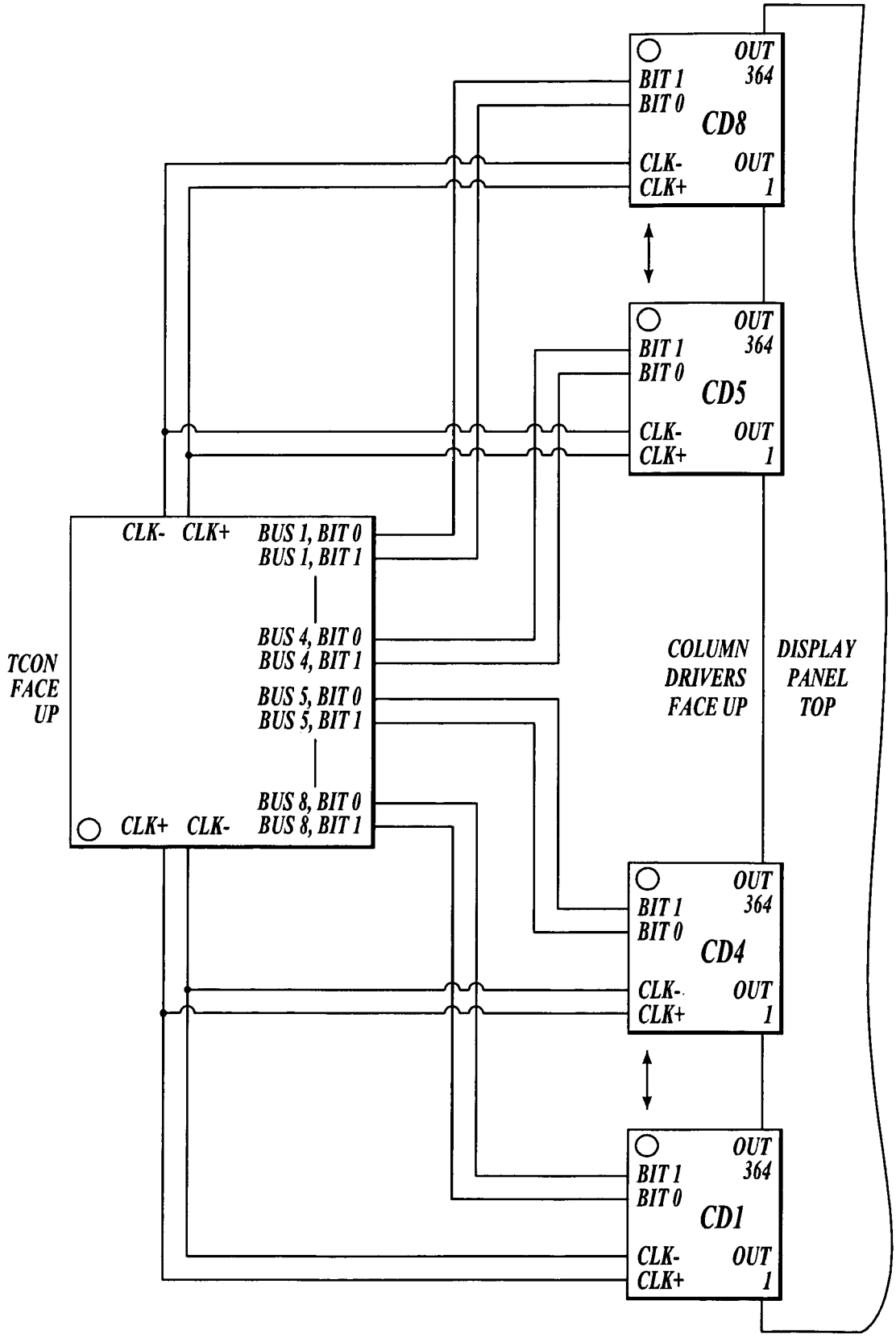
FIG. 4 is a schematic of an example system having a TCON mounted in an upright position and a driver mounted in an upright position at the top of a display in accordance with the present invention.

FIG. 4 is a schematic of an example system having a TCON mounted in an upright (e.g., face up) position and a driver mounted in an upright position at the top of a display in accordance with the present invention. An example TCON having a 2-bit output is shown. Example Drivers CD1-CD8 each have 384 output bits. Drivers CD1-CD8 output data at output data ports Out1-Out384 in response to pixel data that is serially received on bit lines bit1 and bit2. The clock signals, the bit signals, the data busses (e.g., Bus1-8) and the output pins of Drivers CD1-CD8 are not inverted with respect to their intended function. Accordingly, data swapping, bus swapping, and bit swapping are not enabled.

Figure 5:
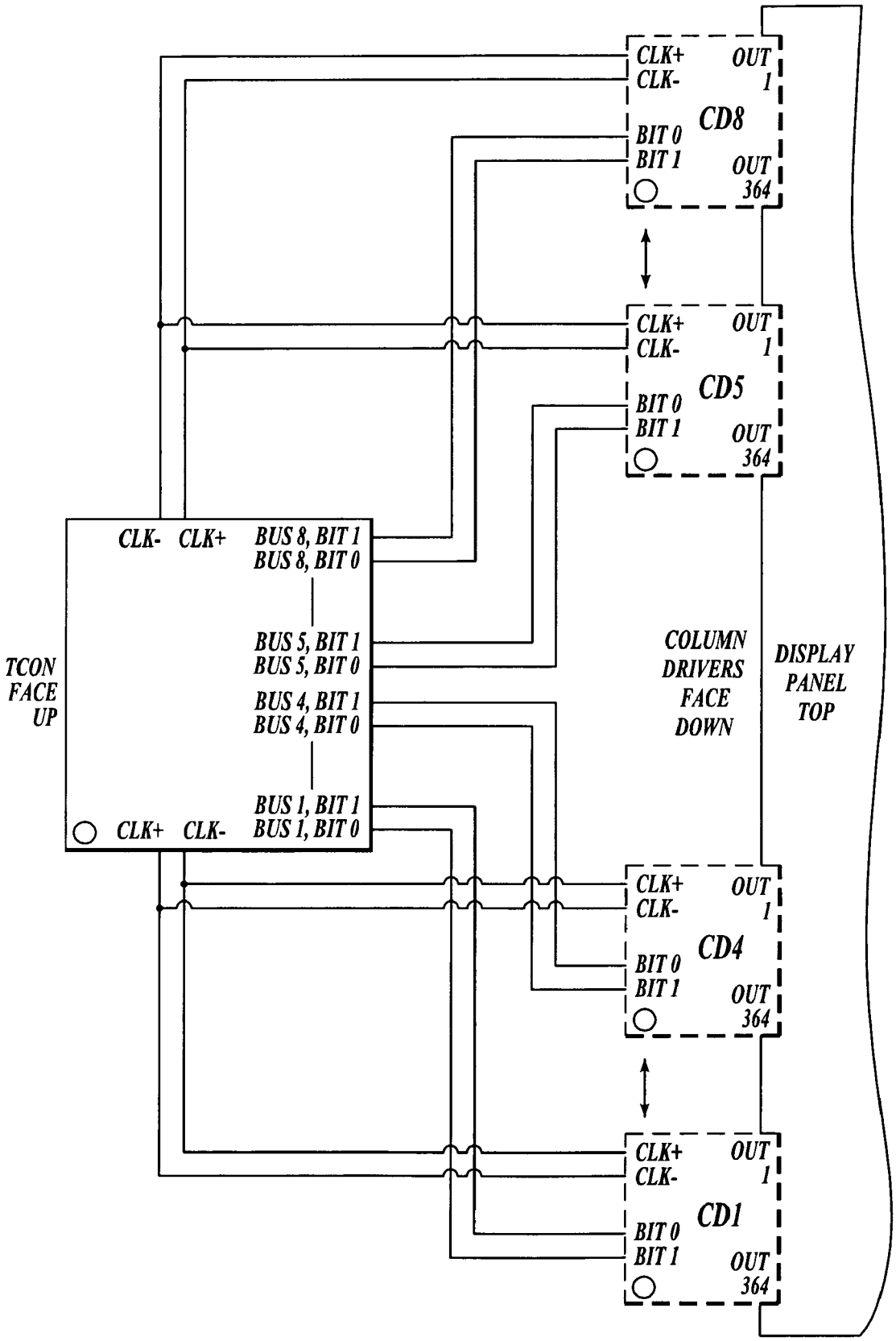
FIG. 5 is a schematic of an example system having a TCON mounted in an upright position and a driver mounted in an upside down position at the top of a display in accordance with the present invention.

FIG. 5 is a schematic of an example system having a TCON mounted in an upright position and a driver mounted in an upside down (e.g., face down) position at the top of a display in accordance with the present invention. The data busses are not inverted with respect to their intended function. The clock signals, the bit signals, and the output pins of Drivers CD1-CD8 are inverted with respect to their intended function. Accordingly, bus swapping is not enabled, and data swapping and bit swapping are enabled.

Figure 6:
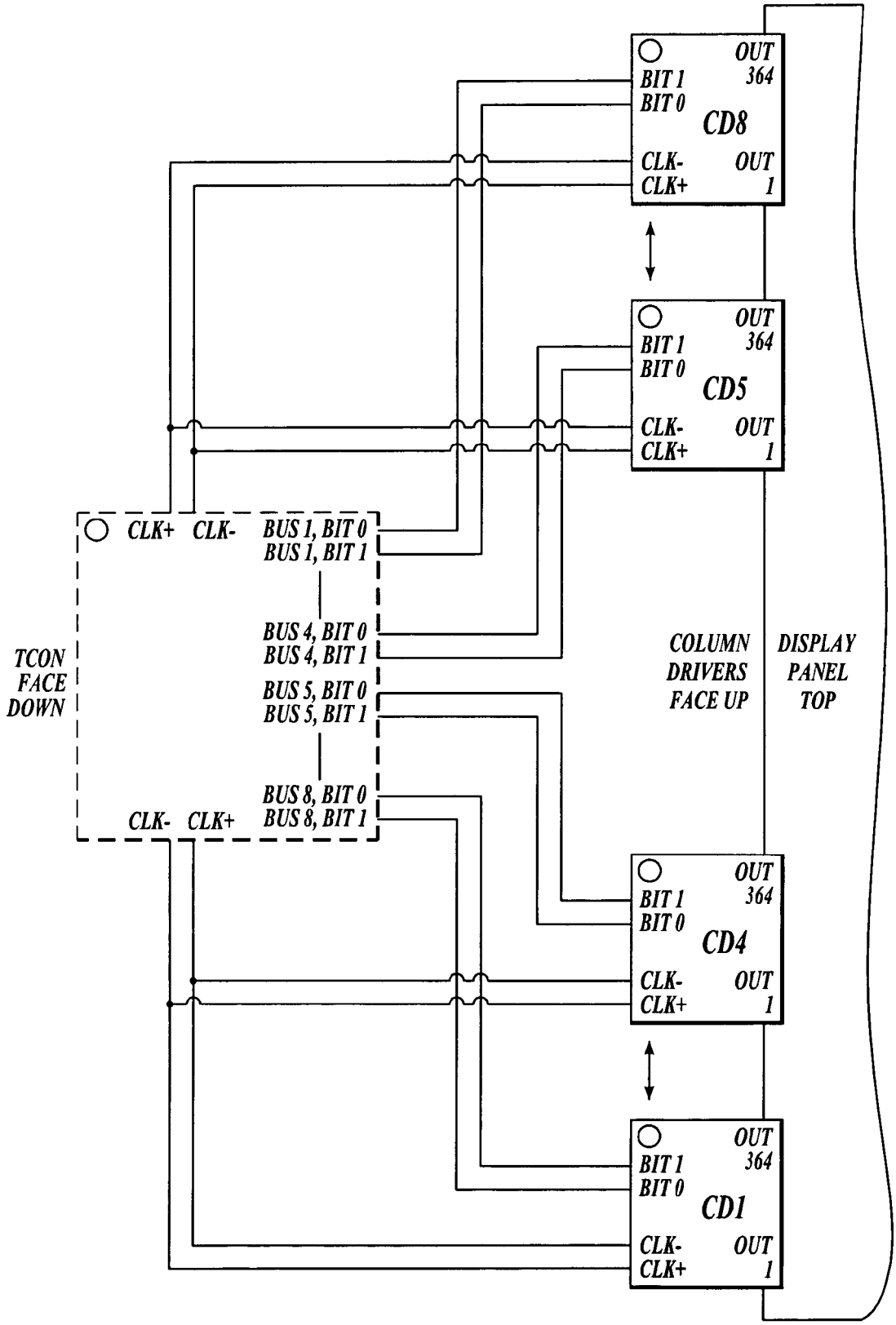
FIG. 6 is a schematic of an example system having a TCON mounted in an upside down position and a driver mounted in an upright position at the top of a display in accordance with the present invention.

FIG. 6 is a schematic of an example system having a TCON mounted in an upside down position and a driver mounted in an upright position at the top of a display in accordance with the present invention. The output pins of Drivers CD1-CD8 are not inverted with respect to their intended function. The clock signals, the bit signals, and the data busses are inverted with respect to their intended function. Accordingly, data swapping is not enabled, and bus swapping and bit swapping are enabled.

Figure 7:
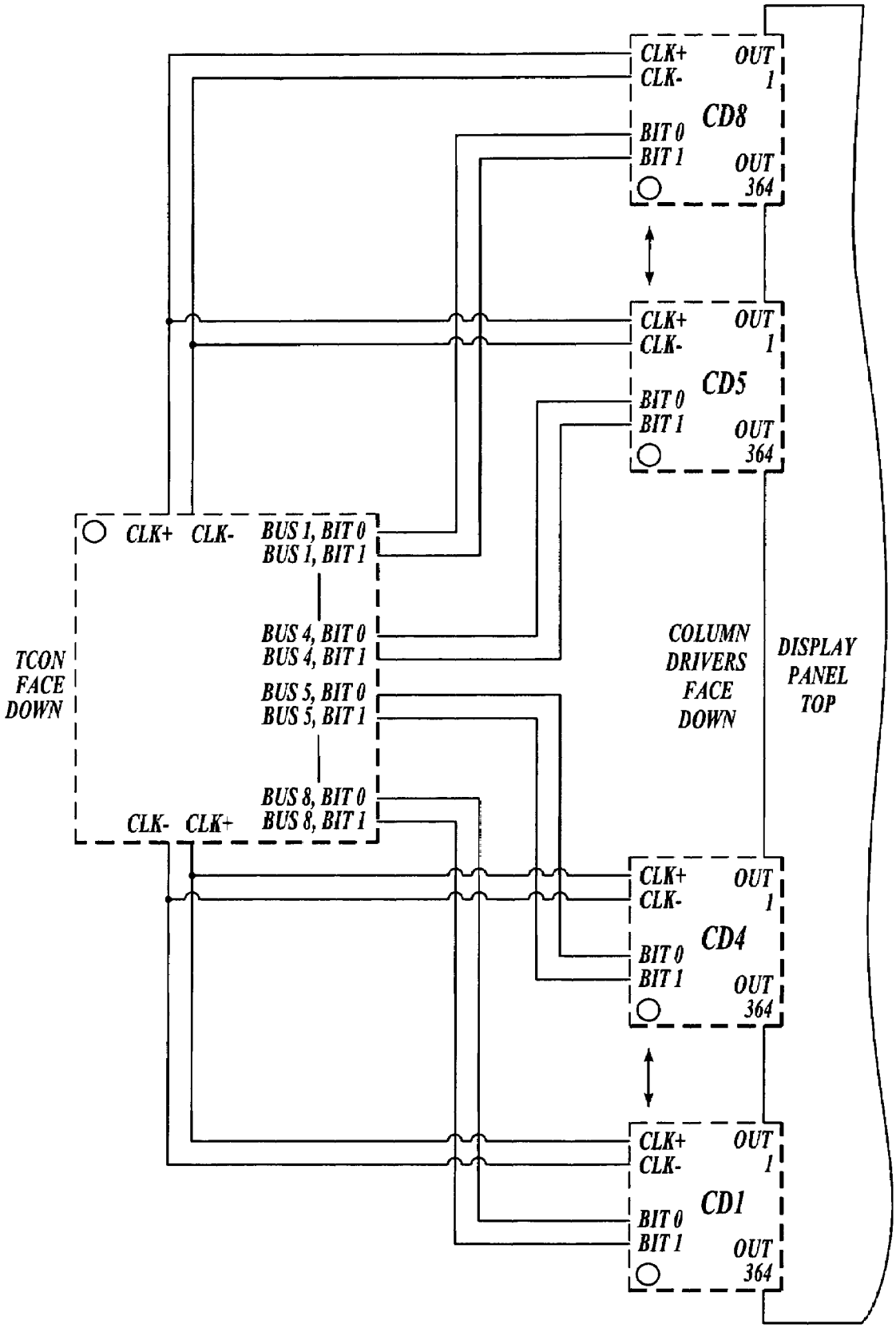
FIG. 7 is a schematic of an example system having a TCON mounted in an upside down position and a driver mounted in an upside down position at the top of a display in accordance with the present invention.

FIG. 7 is a schematic of an example system having a TCON mounted in an upside down position and a driver mounted in an upside down position at the top of a display in accordance with the present invention. The clock signals and the bit signals are not inverted with respect to their intended function. The output pins of Drivers CD1-CD8 and the data busses are inverted with respect to their intended function. Accordingly, bit swapping is not enabled, and data swapping and bus swapping are enabled.

Figure 8:
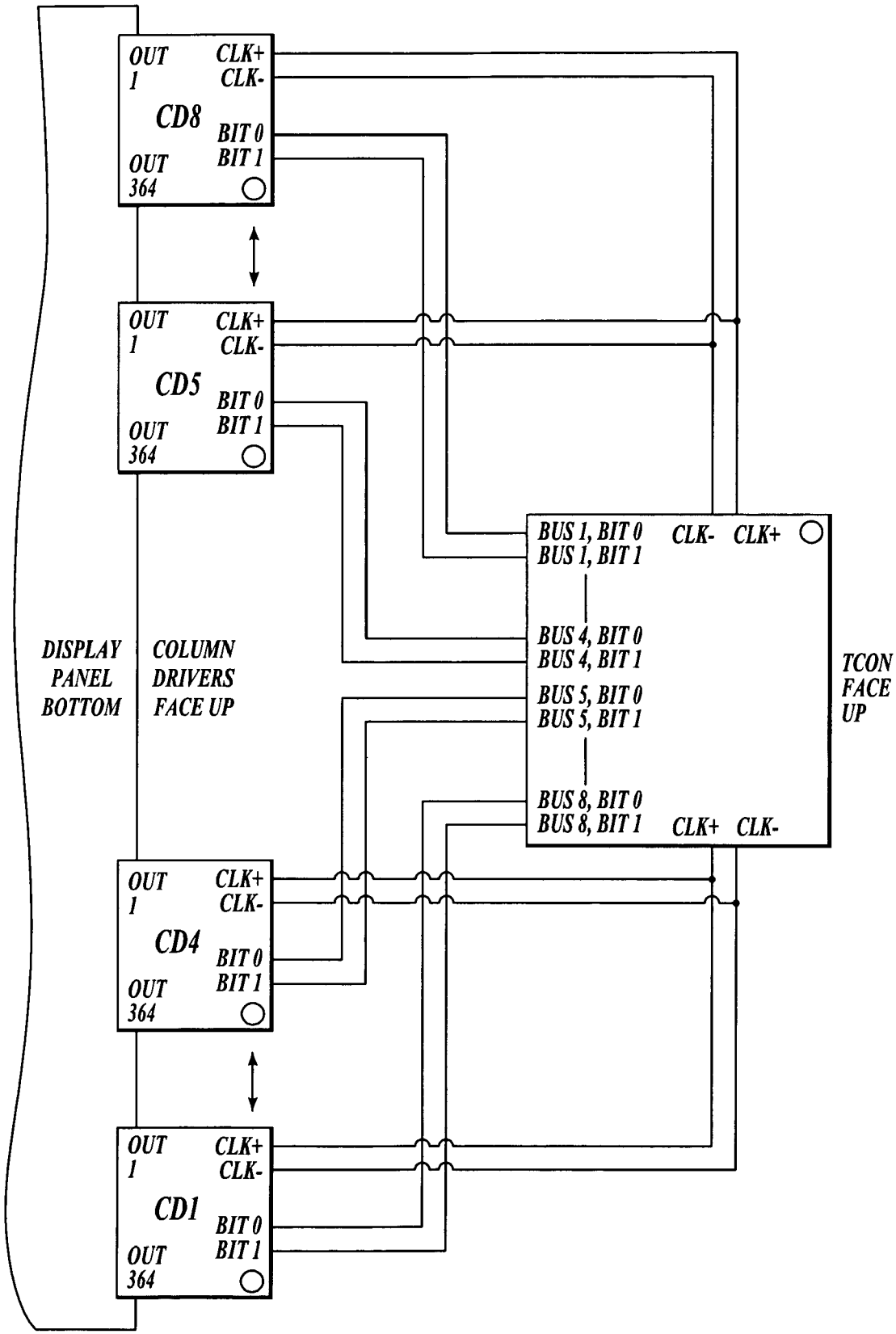
FIG. 8 is a schematic of an example system having a TCON mounted in an upright position and a driver mounted in an upright position at the bottom of a display in accordance with the present invention.

FIG. 8 is a schematic of an example system having a TCON mounted in an upright position and a driver mounted in an upright position at the bottom of a display in accordance with the present invention. The clock signals and the bit signals are not inverted with respect to their intended function. The output pins of Drivers CD1-CD8 and the data busses are inverted with respect to their intended function. Accordingly, bit swapping is not enabled, and data swapping and bus swapping are enabled.

Figure 9:
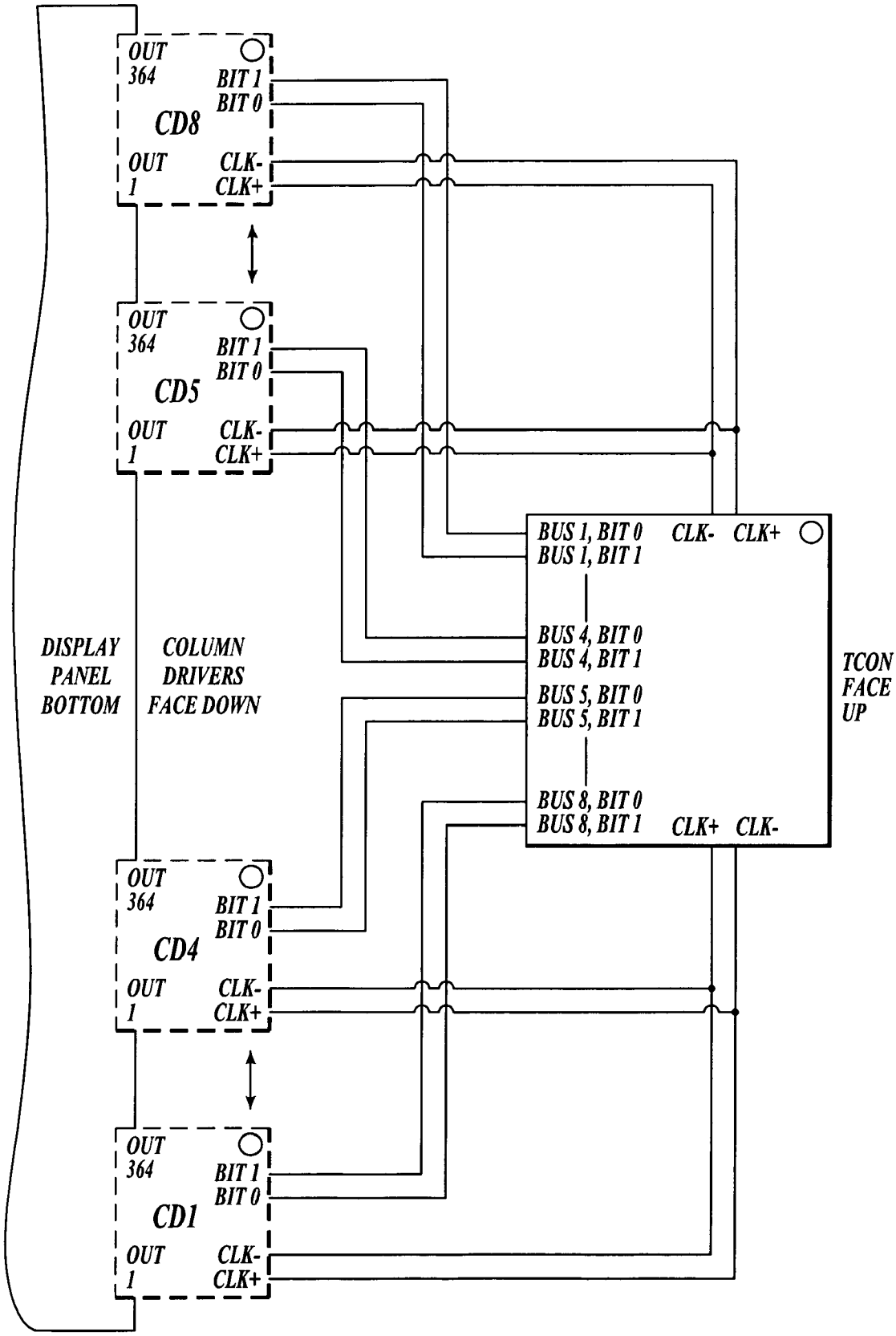
FIG. 9 is a schematic of an example system having a TCON mounted in an upright position and a driver mounted in an upside down position at the bottom of a display in accordance with the present invention.

FIG. 9 is a schematic of an example system having a TCON mounted in an upright position and a driver mounted in an upside down position at the bottom of a display in accordance with the present invention. The output pins of Drivers CD1-CD8 are not inverted with respect to their intended function. The clock signals, the bit signals, and the data busses are inverted with respect to their intended function. Accordingly, data swapping is not enabled, and bus swapping and bit swapping are enabled.

Figure 10:
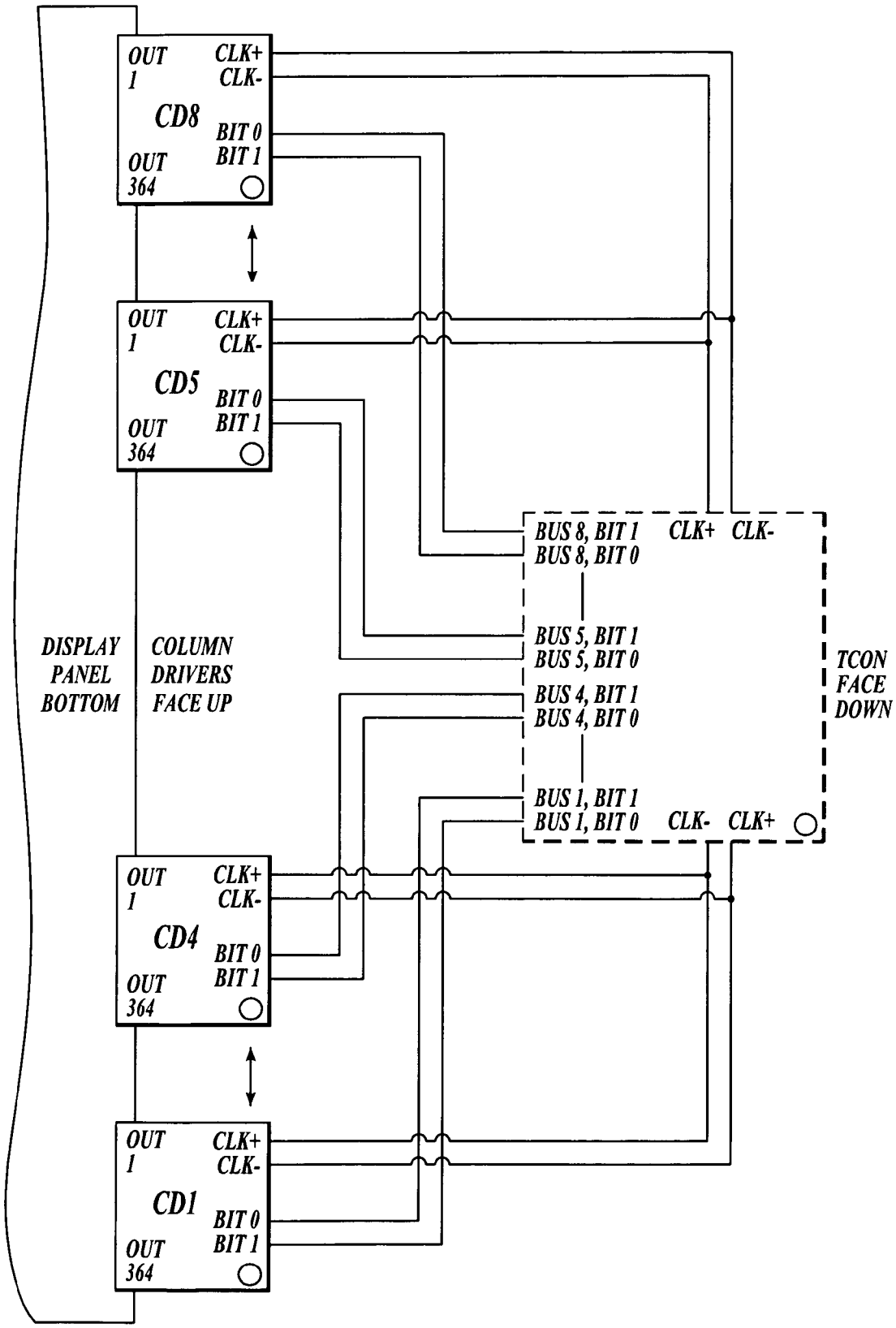
FIG. 10 is a schematic of an example system having a TCON mounted in an upside down position and a driver mounted in an upright position at the bottom of a display in accordance with the present invention.

FIG. 10 is a schematic of an example system having a TCON mounted in an upside down position and a driver mounted in an upright position at the bottom of a display in accordance with the present invention. The data busses are not inverted with respect to their intended function. The clock signals, the bit signals, and the output pins of Drivers CD1-CD8 are inverted with respect to their intended function. Accordingly, bus swapping is not enabled, and data swapping and bit swapping are enabled.

Figure 11:
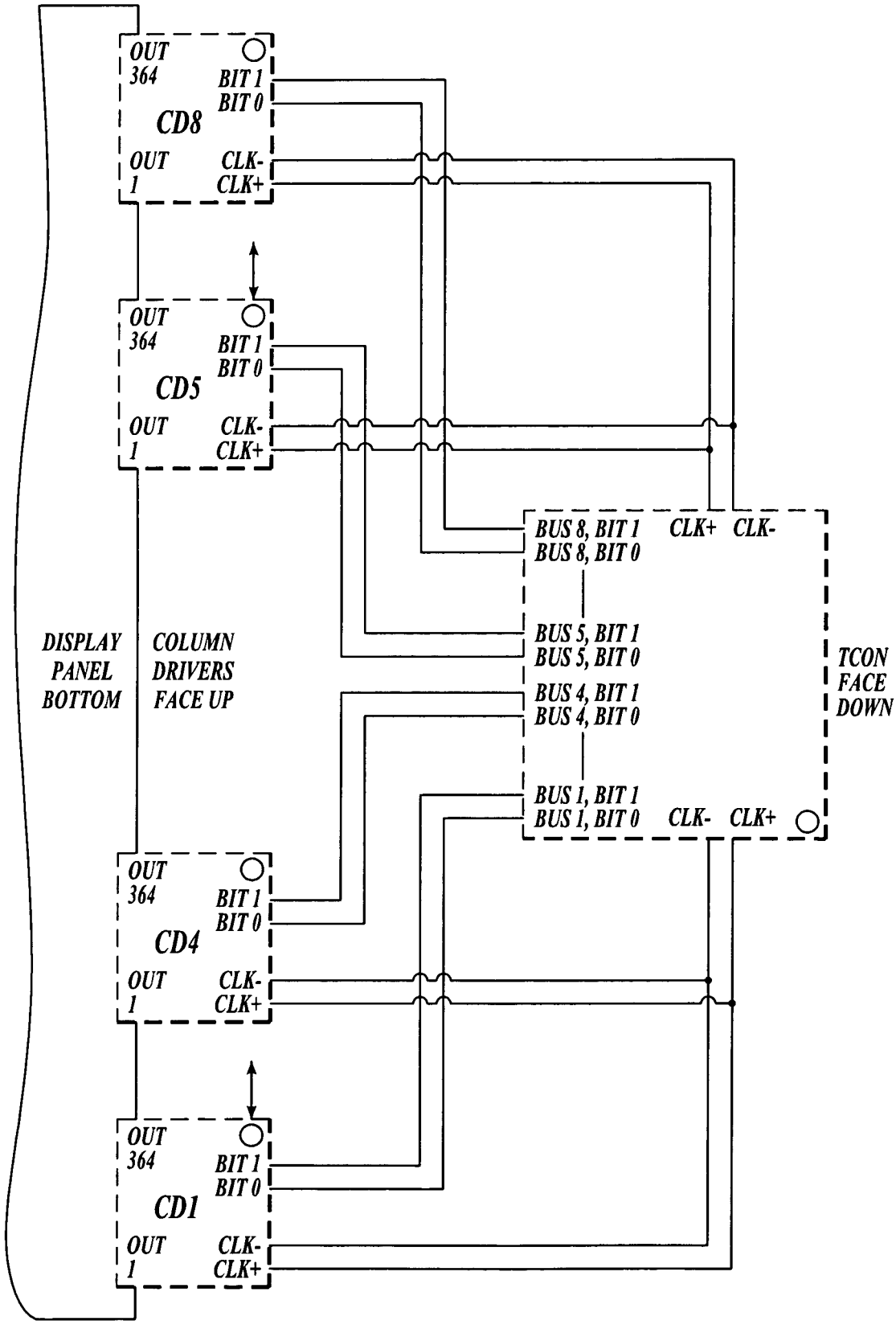
FIG. 11 is a schematic of an example system having a TCON mounted in an upside down position and a driver mounted in an upside down position at the bottom of a display in accordance with the present invention.

FIG. 11 is a schematic of an example system having a TCON mounted in an upside down position and a driver mounted in an upside down position at the bottom of a display in accordance with the present invention. The clock signals, the bit signals, the data busses, and the output pins of Drivers CD1-CD8 are not inverted with respect to their intended function. Accordingly, data swapping, bus swapping, and bit swapping are not enabled.

Other embodiments of the invention are possible without departing from the spirit and scope of the invention. For example, the data formatting function of Bit Swap Multiplexers 230 can be implemented at any stage of TCON 110. The above specification, examples and data provide a complete description of the manufacture and use of the composition of the invention. Since many embodiments of the invention can be made without departing from the spirit and scope of the invention, the invention resides in the claims hereinafter appended.

We claim:

1. A point-to-point display system, comprising:

a host system that is configured to provide data for display;

a timing controller that is configurable to provide at least one operation from a group comprising data swapping, data bus swapping, data bit swapping, and combinations thereof to provide arranged data in response to the provided data, wherein the at least one operation is selected in response to a mounting orientation of the timing controller; and a display that is configured to display the arranged data.

2. The system of claim 1, wherein the timing controller is further configured to swap data by transmitting data in a reverse order.

3. The system of claim 1, wherein the timing controller is further configured to swap data by transmitting data in a reverse order from an order in which the data is read from a memory.

4. The system of claim 1, wherein the timing controller is further configured to swap point-to-point busses by exchanging higher order point-to-point busses with lower order point-to-point busses.

5. The system of claim 1, wherein the timing controller is further configured to swap bits within each point-to-point bus by exchanging higher order bits with lower order bits.

6. The system of claim 1, wherein the timing controller is further configured to invert a clock signal when swapping bits.

7. The system of claim 1, wherein the timing controller is further configured to change the width of each word of data.

8. A circuit for arranging display data in a point-to-point display system, comprising:

means for providing data for display;

means to provide data swapping, bus swapping, bit swapping, and combinations thereof to provide arranged data in response to the provided data, wherein the bit swapping further comprises inverting a clock signal; and means for displaying the arranged data.

9. The circuit of claim 8, wherein the means to provide data swapping swaps data by transmitting data in a reverse order.

10. The circuit of claim 8, wherein the means to provide data swapping swaps data by transmitting data in a reverse order from an order in which the data is read from a memory.

11. The circuit of claim 8, wherein the means to provide bus swapping swaps point-to-point busses by exchanging higher order point-to-point busses with lower order point-to-point busses.

12. The circuit of claim 8, wherein the means to provide bit swapping swaps bits within each point-to-point bus by exchanging higher order bits with lower order bits.

13. A method for arranging display data in a point-to-point display system, comprising:

receiving data from a host system for display;

data swapping, bus swapping, bit swapping, and combinations thereof on the data to provide arranged data, wherein the bit swapping further comprises inverting a clock signal; and displaying the arranged data.

14. The method of claim 13, wherein the data swapping further comprises transmitting data in a reverse order.

15. The method of claim 13, wherein the data swapping further comprises transmitting data in a reverse order from an order in which the data is read from a line memory.

16. The method of claim 13, wherein the bus swapping further comprises swapping point-to-point busses by exchanging higher order point-to-point busses with lower order point-to-point busses.

17. The method of claim 13, wherein the bit swapping further comprises swapping bits within each point-to-point bus by exchanging higher order bits with lower order bits.

18. The method of claim 13, further comprising changing the width of each word of data.

19. The method of claim 13, further comprising providing a control signal for arranging the data.

20. A point-to-point display system, comprising:

a host system that is configured to provide data for display;

a timing controller that is configurable to provide data swapping, bus swapping, bit swapping, and combinations thereof to provide arranged data in response to the provided data and a physical orientation of the timing controller; and a display that is configured to display the arranged data.

21. The system of claim 20, wherein the timing controller is further configured to swap data by transmitting data in a reverse order.

* * * * *